US006976917B2

(12) United States Patent
Peccole, Jr.

(10) Patent No.: US 6,976,917 B2
(45) Date of Patent: Dec. 20, 2005

(54) ELECTRONIC POKER STYLE GAME

(76) Inventor: Robert N. Peccole, Jr., 8238 W. Charleston Blvd., Las Vegas, NV (US) 89117

( * ) Notice: Subject to any disclaimer, the term of this patent is extended or adjusted under 35 U.S.C. 154(b) by 215 days.

(21) Appl. No.: 10/103,203

(22) Filed: Mar. 20, 2002

(65) Prior Publication Data

US 2003/0181232 A1 Sep. 25, 2003

(51) Int. Cl.[7] ..... A63F 9/24
(52) U.S. Cl. ..... 463/13; 273/292
(58) Field of Search ..... 463/1, 12–25, 463/40–42, 13; 273/292, 293, 303

(56) References Cited

U.S. PATENT DOCUMENTS

| | | | | | |
|---|---|---|---|---|---|
| 4,560,161 | A * | 12/1985 | Hamano | 463/13 |
| 5,807,172 | A * | 9/1998 | Piechowiak | 463/20 |
| 5,868,619 | A * | 2/1999 | Wood et al. | 463/13 |
| 5,882,260 | A * | 3/1999 | Marks et al. | 463/13 |
| 5,901,958 | A * | 5/1999 | Andrews | 273/292 |
| 5,908,353 | A * | 6/1999 | Andrews | 463/13 |
| 5,971,849 | A * | 10/1999 | Falciglia | 463/16 |
| 6,059,658 | A * | 5/2000 | Mangano et al. | 463/16 |
| 6,098,985 | A * | 8/2000 | Moody | 273/292 |
| 6,120,378 | A * | 9/2000 | Moody et al. | 463/20 |
| 6,126,542 | A * | 10/2000 | Fier | 463/16 |
| 6,149,157 | A * | 11/2000 | Suan | 273/292 |
| 6,220,959 | B1 * | 4/2001 | Holmes et al. | 463/13 |
| 6,251,013 | B1 * | 6/2001 | Bennett | 463/13 |
| 6,270,405 | B1 * | 8/2001 | Ferguson | 463/13 |
| 6,322,445 | B1 * | 11/2001 | Miller | 463/13 |
| 6,443,456 | B1 * | 9/2002 | Gajor | 273/303 |
| 6,474,645 | B2 * | 11/2002 | Tarantino | 273/274 |
| 6,511,068 | B1 * | 1/2003 | Sklansky et al. | 273/237 |
| 6,592,125 | B1 * | 7/2003 | Lizak | 273/292 |
| 2002/0074725 | A1 * | 6/2002 | Stern | 273/274 |
| 2002/0187823 | A1 * | 12/2002 | Khal | 463/13 |

* cited by examiner

*Primary Examiner*—Michael O'Neill
(74) *Attorney, Agent, or Firm*—Rob L. Phillips; Greenberg Traurig

(57) ABSTRACT

An electronically implemented method of playing a poker style video game displaying a 5×4 matrix. The rows are each preassigned a single card value from the group consisting of Tens, Jacks, Queens, Kings or Aces. Only Tens, Jacks, Queens, Kings and Aces of each suit, namely Spades, Clubs, Hearts and Diamonds, from a standard 52 card deck are utilized. The twenty cards are randomly shuffled and dealt into the 5×4 matrix. Pay outs are based on the number of Tens in the preassigned Tens row, Jacks in the preassigned Jacks row, etc. Additional pay outs are based on the cards in each of the columns. Column pay outs include straights and royal flushes. Preferably, players are allowed to select which initially dealt cards to hold and which to discard. The discards are shuffled and randomly re-dealt a second time to the unoccupied spaces of the matrix.

14 Claims, 3 Drawing Sheets

ELECTRONIC POKER STYLE GAME

FIELD OF INVENTION

The present invention relates generally to an electronically implemented video poker game. More particularly, a video poker game which includes a matrix display having five rows and four columns (i.e. a 5×4 matrix). Each of the five rows is pre-assigned a particular unique card value (e.g. Ten, Jack, Queen, King and Ace). Players win pay outs based on winning combinations defined by the final cards in the rows and/or columns.

DESCRIPTION OF THE PRIOR ART

Poker has always been the most popular wagering card game in the world and will undoubtedly continue to be so. Casinos have long benefitted from both live poker games and electronic video poker machines. "Video poker", as it is commonly known, first consists of a player inserting a wager into a video poker machine. Thereafter, the player is dealt five face-up cards from a standard 52 card deck. The player then decides which of the five dealt cards to hold and which to discard. The discards are replaced by new cards from the remaining cards in the deck. The player, according to a pre-established pay table, is paid for the resultant poker hand (e.g. 4000 coins for a royal flush, 250 coins for 4 of a kind, etc.).

With the increased popularity of video poker, gaming machine operators continue to desire new variations on the common popular principles. The common principles being a game based on poker that is easy to learn and quick to play. However, many of the new games are more aptly termed "gimmicks" as they neglect the common principles.

The present invention not only relies on the common principles, it is further preferably designed around the royal flush (i.e. Ten, Jack, Queen, King and Ace of same suit) which is the ultimate poker hand achievable in a non-wild card poker game. Frequently, players of traditional video poker attempt to acquire a royal flush and the large payout associated therewith. Also frequently, players are unsuccessful in achieving the royal flush because the odds are considerably against the player. The present invention increases a player's odds of achieving one or more royal flushes. Of course, with the increased odds comes decreased pay outs, but players will feel a sense of accomplishment by achieving the ultimate hand. The present invention uses only 20 cards, preferably Tens, Jacks, Queens, Kings and Aces of each suit, from a standard 52 card deck. While other cards are possible, it is preferred that Tens through Aces be used so that the possibility of a royal flush is incorporated within the game. A display of the present invention includes a matrix of five rows and four columns. The five rows correspond to a particular card value (e.g. Ten, Jack, Queen, King and Ace). Winning combinations are defined by the final cards in both the rows and the columns of the matrix. Winning row combinations may consist of a pair, three of a kind and four of a kind. Winning column combinations may include straights and royal flushes.

U.S. Pat. No. 6,120,378 (the '378 patent) to Moody et al., describes a 5×5 matrix style slot-machine allowing players to select displayed symbols from a first pay line or row such that the identical symbols are placed into the remaining four pay lines or rows. Thereafter, the remaining spaces are filled in a conventional slot machine style. However, the game does not provide a payout based on the vertical symbol combinations achieved. Moreover, while the '378 patent could use standard playing cards as symbols, the game and method of play does not permit pay outs based on vertical combinations since the held symbols are transposed into each other row meaning that each column contains the same five symbols each time a symbol is selected.

U.S. Pat. No. 6,220,959 B1 (the '959 patent) to Holmes, Jr. et al., describes a video poker game having a 5×5 matrix of cards. Each row is dealt from a different standard 52 card deck. Twelve distinct pay outs are based on poker hands defined by five rows, five columns and two diagonals. Although, the '959 patent describes pay outs based on both rows and columns, it does not limit the game to twenty cards from a standard deck such that every card is used each game. Nor does the patented game afford the player significantly greater odds of achieving a royal flush. Moreover, the '959 patent eliminates the significance of card suits so as to simplify the pay table.

The present invention incorporates the common popular principles of traditional video poker while providing players with multiple pay outs and a sense of accomplishment by dealing royal flushes more frequently. Preferably, players are afforded one opportunity to hold selected cards and to discard selected cards. The discards are shuffled and re-dealt to fill the spaces left by the discards. In this manner, all twenty cards are used each play of the game.

SUMMARY OF THE INVENTION

An object of the present invention is to provide multiple pay outs based on both rows and columns of dealt cards.

Another object of the present invention is to provide a gaming machine player with more likelihood of achieving a royal flush.

Another object of the present invention is to provide a quick-paced video poker style game.

Another object of the present invention is to provide a game requiring a player to have a minimum skill level.

Yet another object of the present invention is to provide a video poker style game using only a portion of the cards from a standard 52 card deck, more particularly Tens, Jacks, Queens, Kings and Aces of each suit.

DESCRIPTION OF THE INVENTION

The present invention seeks to combine the common popular principles of video poker into a new and exciting modified version thereof. A 5×4 matrix is displayed on a gaming machine display. The display includes a CRT screen, a plasma screen or any suitable display screen. Each of the 5 rows of the matrix is pre-assigned a unique card value. Preferably, the unique card values are Tens, Jacks, Queens, Kings and Aces. Based on the pre-assigned values, only the Tens, Jacks, Queens, Kings and Aces of each suit are used from a standard 52 card deck.

Once a player places a wager and said wager is accepted by a gaming machine, the twenty cards are dealt until each of the twenty matrix spaces are filled. There are infinite deal patterns the game can follow. Thereafter, the player is preferably permitted to select, one time, which of the dealt cards to hold and which to discard. The discards are shuffled and re-dealt into the unoccupied spaces of the matrix. Discarding and being re-dealt replacement cards is known as "drawing cards". In other embodiments, the player may be able to draw on more than one occasion. In either case, the player of the present invention receives the same cards that were discarded but they are likely to appear in different matrix spaces.

The rows and columns of final cards are then compared to a pre-established pay table to determine whether the player is entitled to a pay out. Preferably, row pay outs are based on a pair, three of a kind and four of a kind where the card value of the pair, three of a kind and four of a kind correspond to the pre-assigned value of the row. Column pay outs are based on straights and royal flushes.

DISCLOSURE OF THE EMBODIMENTS

Figure 1:
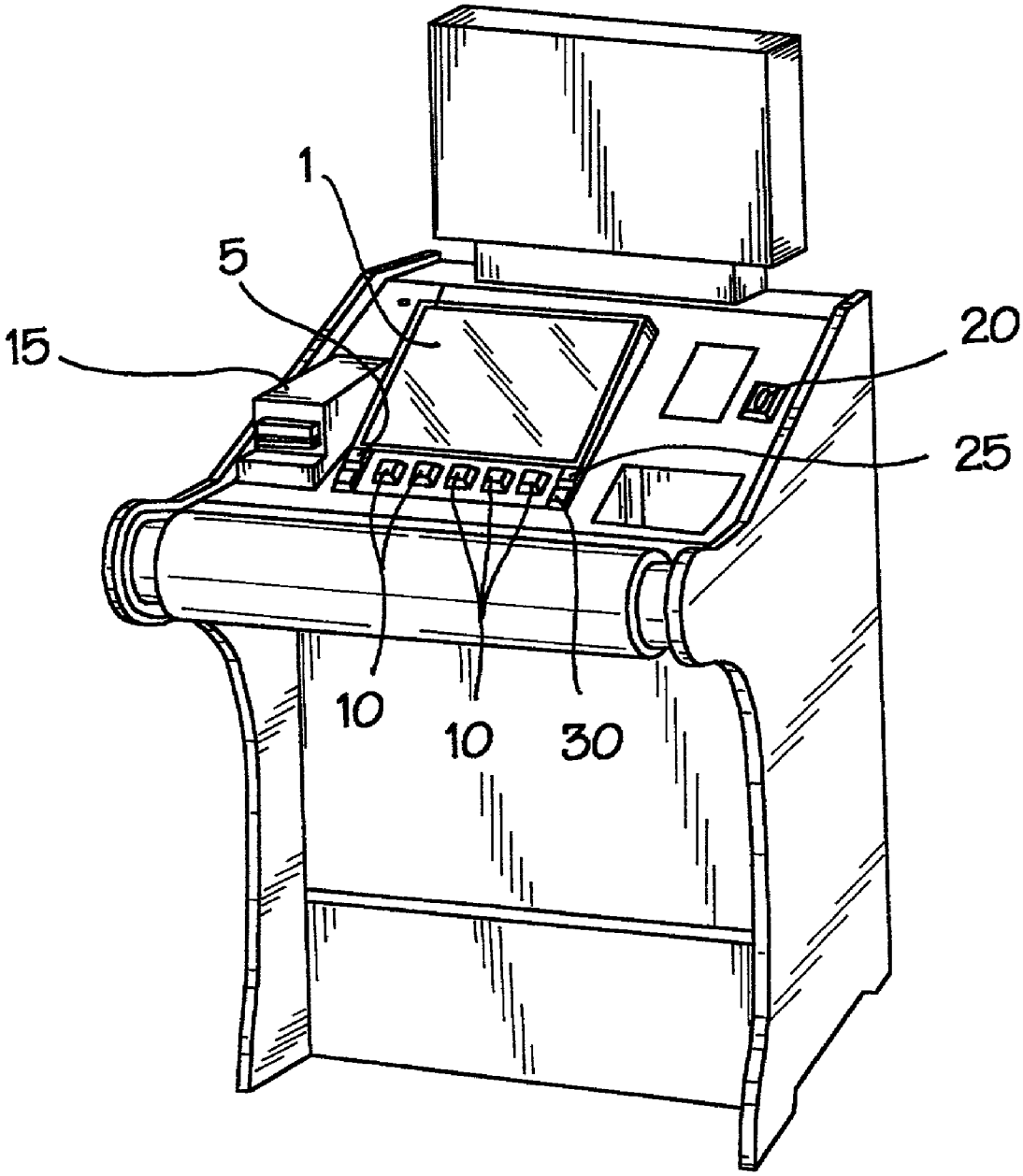
FIG. 1 is a front view of a conventional video poker machine used to implement the present invention.

The present invention is implemented with conventional video poker machines. Reference is now made to the figures wherein like parts are referred to by like numerals throughout. FIG. 1 illustrates the front of a traditional video poker machine, including a screen display 1, draw/deal button 5, hold/discard buttons 10, card reader 15, coin slot 20, bet maximum coins button 25 and bet one coin button 30. In addition to the external features illustrated in FIG. 1, the present invention requires a means for holding and discarding up to twenty cards as opposed to only five cards as with traditional video poker. Although a touchscreen is the preferred means of selection, other means, including additional selection buttons, may be used.

Figure 2:
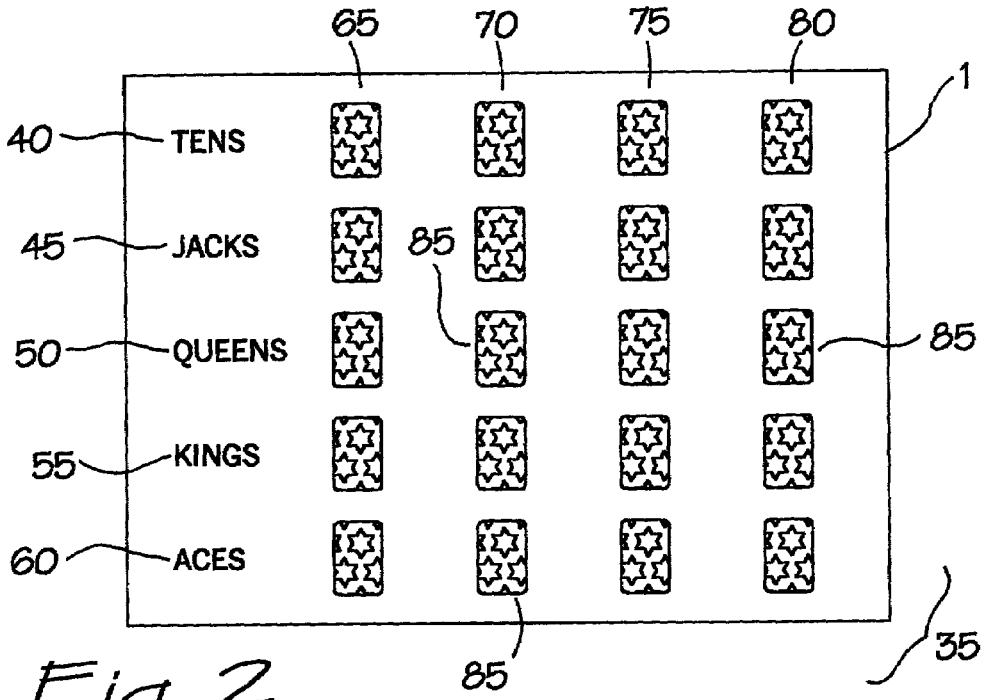
FIG. 2 is a view of a display screen of the present invention prior to a player's cards being revealed.

As illustrated in FIG. 2, prior to play the screen display 1 will show a matrix 35 having five rows and four columns. As defined by algebra, matrix 35 is an "m×n" (said "m by n") matrix with "m" being the number of rows and "n" being the number of columns. Each of the five rows is pre-assigned a unique card value, preferably Tens 40, Jacks 45, Queens 50, Kings 55 and Aces 60. The particular order is irrelevant, but for simplicity should be in sequence from top to bottom or bottom to top. The four columns 65, 70, 75, 80 may or may not have a heading depending on the manufacture and operators of the game. Within the twenty spaces defined by the matrix 35 are twenty face down cards 85. The twenty cards 85 are all of the cards used to practice the present invention. Preferably, the twenty cards 85 are the Tens, Jacks, Queens, Kings and Aces of each suit from a standard 52 card deck. Alternatively, the cards do not have to be shown face down prior to play, but may be dealt face up once a player places a wager.

Regardless of the initial position of the twenty cards, the internal components of the gaming machine randomly determine the order of the dealt cards. A traditional video poker machine used to implement the present invention includes a preprogrammed microprocessor in communication with certain memory devices. The microprocessor further includes, or is in communication with, a random number generator (RNG) that runs hundreds of hands per second (i.e. shuffles the cards) until the occurrence of a predetermined event (i.e. coin insertion, bet button is depressed or start button is depressed). Once the predetermined event occurs, the cards are dealt as they are situated in the deck. A pre-established pattern of dealing the cards into the matrix is arbitrary. For example, the cards may be dealt by left to right by row, top to bottom by column or randomly. The deal patterns are infinite and regardless of the final pattern, do not affect the scope of the present invention. Thereafter, a re-deal is allowed and the discards are shuffled a predefined period of time or a predefined number of times and re-dealt accordingly. Again, the re-deal can follow any selected pattern.

To begin play, a player inputs coins, currency, a credit card or other payment device. If desired, the player may wager on specific rows only. However, as with most gaming machines, it is preferred that a player wager the maximum number of coins per play. Typically, playing maximum coins allows players to receive the best pay outs and participate in progressive jackpots and bonus awards. In the instant case, failure to play maximum coins eliminates, at a minimum, the player's participation in pay outs based on winning card combinations defined by the columns 65, 70. 75, 80.

Assuming the player plays maximum coins (e.g. 5 coins), the twenty cards 85 originally displayed face down are now revealed. The player is now attempting to build nine (i.e. five rows and four columns) poker hands simultaneously. A first object for the player is to accumulate as many Tens in the Tens row 40, as many Jacks in the Jacks row 45, as many Queens in the Queens row 50, as many Kings in the Kings row 55 and as many Aces in the Aces row 60. A second simultaneous object is for the player to build royal flushes and straights in the four columns 65, 70, 75, 80.

It should be understood that other card values may be substituted for those described herein. For example, the card values may be twos, threes, fours, fives and sixes. However, the card values described herein will immediately be recognized by the gambling public as cards defining a royal flush. As such, the gambling public, which understands traditional video poker, will be immediately interested in the royal flush concept.

Figure 3:
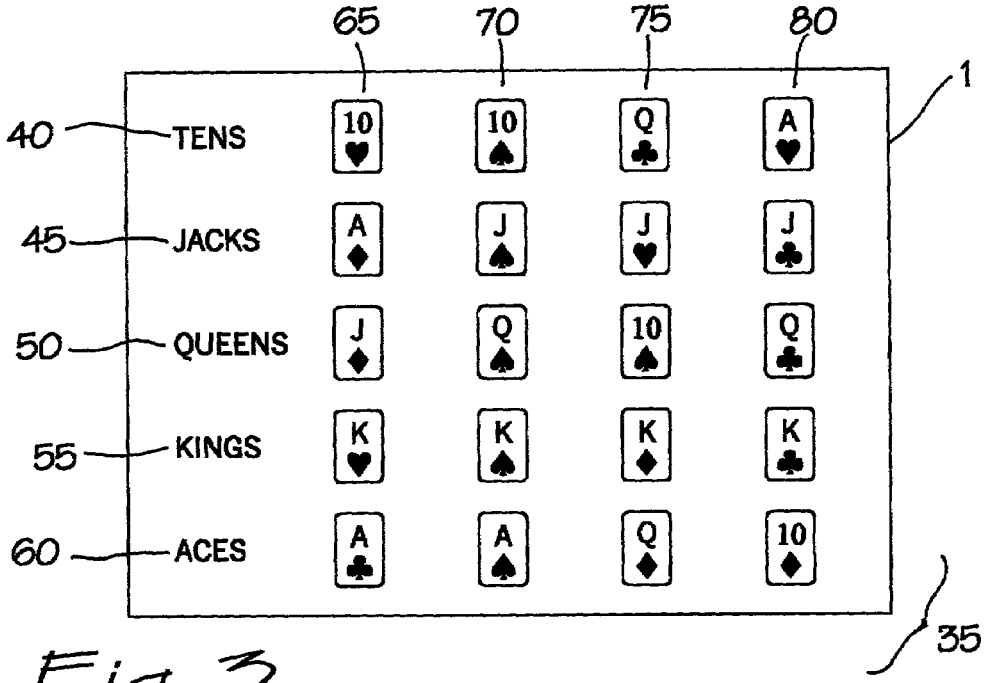
FIG. 3 is a view of a display screen of the present invention immediately after the player's cards have been revealed.

FIG. 3 illustrates the display screen 1 once the player's twenty cards 85 have been revealed. As shown in FIG. 3, the Tens row 40 depicts a pair of Tens in columns 65, 70, the Jacks row 45 depicts three Jacks in columns 70, 75, 80, the Queens row 50 depicts a pair of Queens in columns 70, 80, the Kings row 55 depicts four Kings in columns 65, 70, 75, 80 and the Aces row 60 depicts a pair of Aces in columns 65, 70. Further, column 70 depicts a royal flush and column 80 depicts a straight.

The player is now able to select which cards to hold and which to discard. Depending on the game operator, the player may be able to discard all twenty cards or may be required to hold a pre-designated number of the originally dealt cards. The selection process is based on a pre-established pay table associated with the present invention. While any number of pay tables are possible, preferably players are paid for a pair, three of a kind and four of a kind in the rows 40, 45, 50, 55, 60 and straights and royal flushes in the columns 65, 70, 75, 80. The row pay outs are only earned if the pair, three of a kind or four of a kind are the same card value as the pre-assigned row. For example, the Tens row 40 will only result in a pay out if two Tens, three Tens or four Tens are present, other card values will not be paid in the Tens row 40. Alternatively, the row pay outs may be based on any possible combinations including pay outs for two pair and other combinations.

Figure 4:
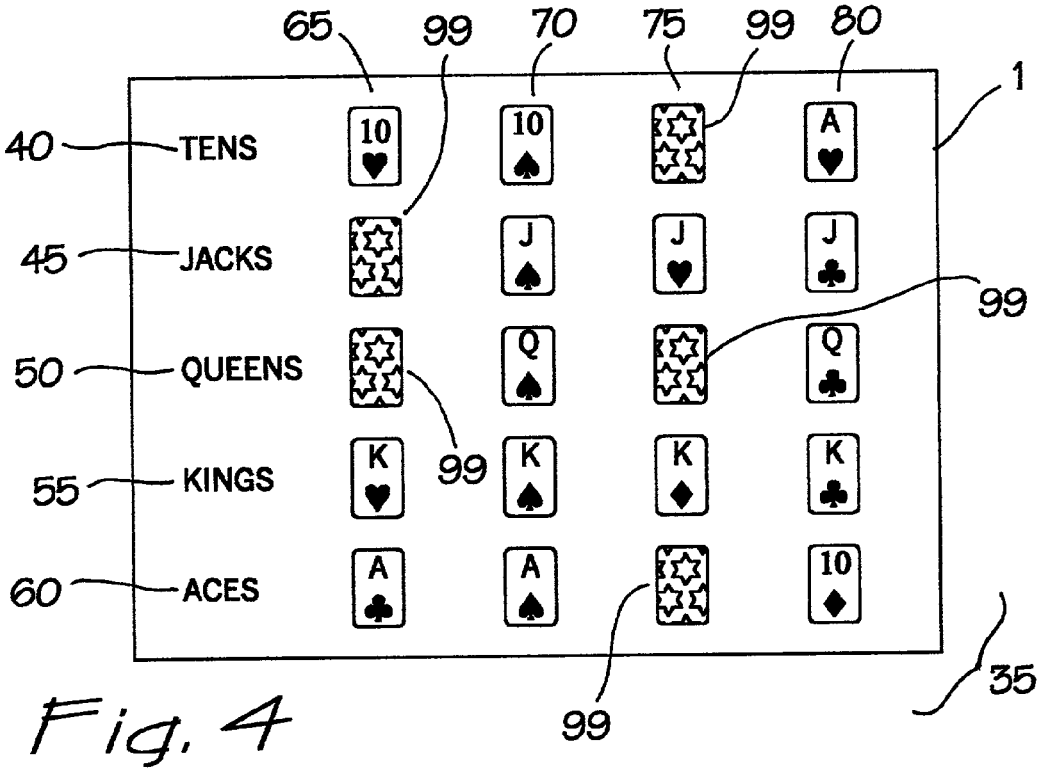
FIG. 4 is a view of a display screen of the present invention immediately after the player has selected which cards to hold and which to discard.

FIG. 4 illustrates the display screen 1 showing the held cards and depicting the discards as face down cards 99 in the matrix 35. As shown, the player has discarded dealt cards corresponding to column 65—Jacks row 45, column 65—Queens row 50, column 75—Tens row 40, column 75—Queens row 50 and column 75—Aces row 60, namely the Ace of Diamonds, Jack of Diamonds, Queen of Clubs, Ten of Spades and Queen of Diamonds respectively. Depending on the pre-established pay table, the player may also decide to break-up the straight in column 80, by discarding the cards corresponding to the Tens row 40 and the Aces row 60, namely the Ace of Hearts and Ten of Diamonds respectively, in an attempt to further improve the hands achievable in the rows 40, 60. Alternatively, the player may also elect to hold the cards corresponding to the Jacks row 40, Queens row 45 and Kings row 50 of column 80, namely the Jack of Clubs, Queen of Clubs and King of Clubs respectively, and discard the cards corresponding to column 80—Tens row 40 and column 80—Aces row 60, namely the Ace of Hearts and the Ten of Diamonds respectively, in an attempt to achieve a royal flush in column 80. Realistically, there are numerous selections the player can make.

Figure 5:
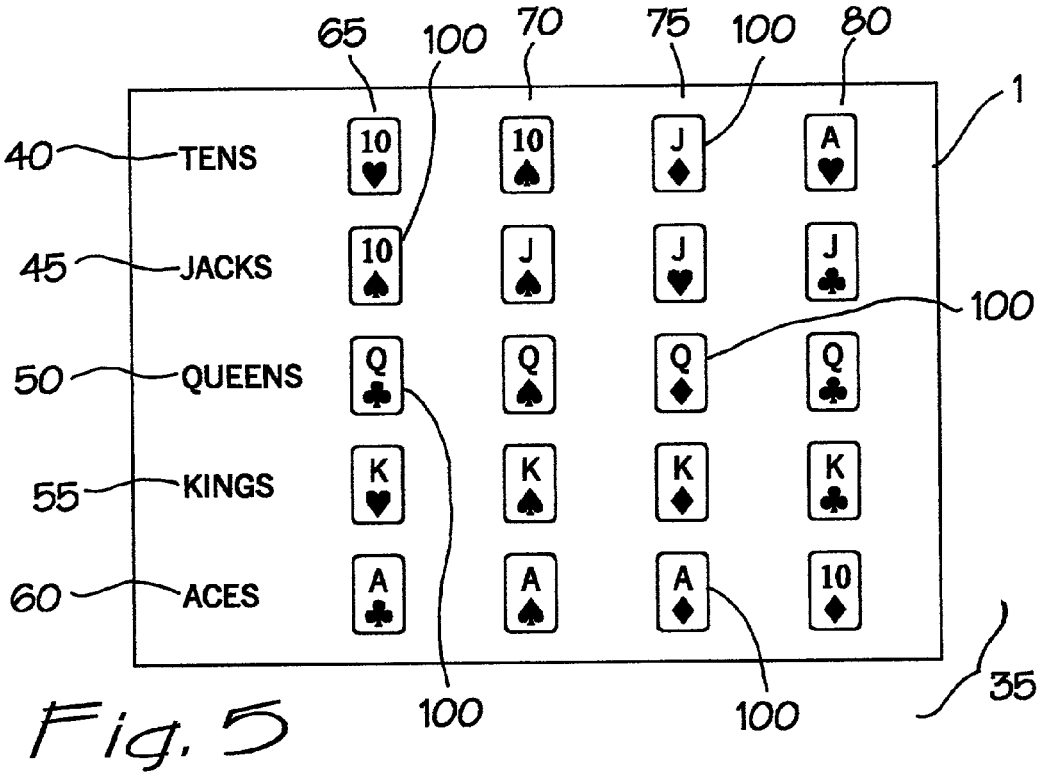
FIG. 5 is a view of a display screen of the present invention once the discards have been replaced by shuffling all discards and randomly re-dealing the same.

FIG. 5 shows the final player hand once the discards have been shuffled and re-dealt. It shows that the original discards, namely the Ace of Diamonds, Jack of Diamonds, Queen of Clubs, Ten of Spades and Queen of Diamonds have been re-dealt to new positions 100 in the matrix 35. The Ten of Spades is now in column 65—Jacks row 45, the Queen of Clubs is now in column 65—Queens row 50, the Jack of Diamonds is now in column 75—Tens row 40, the Queen of Diamonds is now in column 75—Queens row 50, and the Ace of Diamonds is now in column 75—Aces row 60. However, it is possible that some, or all, of the re-dealt cards may appear in their same positions after the second deal as they did prior to the second deal. In FIG. 5, the player's hand has improved as the player now holds, in addition to the winning combinations described above, three Aces in the Aces row 60 and four Queens in the Queens row 50. No other improvements were realized. The player is now paid according to the pre-established pay table for all winning combinations. In the instant case, utilizing the preferred pay table, the winning combinations are a pair of Tens in the Tens row 40, three Jacks in the Jacks row 45, four Queens in the Queens row 50, four Kings in the Kings row 55 and three Aces in the Aces row 60, a royal flush in column 70 and a straight in column 80.

Many variations of the above-described game are possible without departing from the scope of the present invention. For example, the present invention can be played without the necessity of a re-deal so that the original deal of the cards determines the game's outcome. In other words, the original position of the cards are compared to a pre-established pay table and winning combinations are paid without the player having to make any decisions. The game can also include more than one re-deal.

Jackpots associated with the game can take on many forms. In one embodiment, four separate jackpots are created for each column 65, 70, 75, 80. The jackpot is realized upon a player achieving a royal flush in any one of the columns 65, 70, 75, 80. Moreover, five separate jackpots are created for each row 40, 45, 50, 55, 60. The row jackpot is realized upon a player receiving four of kind in a row designating the value of the four of a kind. In this fashion, the jackpot values for each column and row will vary and may entice the player to attempt a royal flush in a column with a large jackpot or four of a kind in a row with a large jackpot. A super jackpot, or progressive jackpot, may be based on a player receiving a royal flush in all columns (which corresponds to four of a kind in each row 40, 45, 50, 55, 60). Progressive jackpots are based on linked gaming machines and create very large and attractive jackpots. Progressive jackpots are known in the art and are therefore not fully described herein. The types, styles and format of the jackpots are ultimately designed and implemented by gaming machine manufacturers and operators and do not limit the scope of the present invention.

The present invention is further adaptable to a non-electronic implementation as well as the electronic format described hereinabove. Twenty cards representing the Tens, Jacks, Queens, Kings and Aces of each suit are removed from a standard 52 card deck. A gaming table layout or gaming board lay out including twenty spaces in the form of a 5×4 matrix is utilized. The physical cards are then dealt in a pre-established pattern or randomly. The rules, strategies and pay outs are equivalent to those for the electronic version. The non-electronic version requires a dealer to conduct the game by dealing the cards and paying players for winning combinations.

Although the invention has been described in detail with reference to a preferred embodiment, additional variations and modifications exist within the scope and spirit of the invention as described and defined in the following claims.

I claim:

1. An electronically implemented method of playing a poker style wagering game including:

a. accepting a player wager;

b. pre-assigning each row or column of an m×n matrix with a unique playing card value, wherein the card values are selected from the group consisting of Twos, Threes, Fours, Fives, Sixes, Sevens, Eights, Nines, Tens, Jacks, Queens, Kings and Aces;

c. dealing and displaying cards from a plurality of playing cards to fill the m×n matrix;

d. comparing the playing cards in each of the m rows, and the n columns, with predefined winning combinations, wherein a first set of pre-established winning combinations is based on poker hand ranks and a second set of pre-established winning combinations is based on matches between cards and the pre-assigned unique playing card rank; and e. paying said player according to a pre-established pay table.

2. The method of playing a poker style wagering game according to claim 1 wherein said matrix is a 5×4 matrix.

3. The method of playing a poker style wagering game according to claim 1 wherein the plurality of playing cards includes Tens, Jacks, Queens, Kings and Aces of each card suit namely Spades, Clubs, Hearts and Diamonds from a standard 52 card deck.

4. The method of playing a poker style wagering game according to claim 1 wherein the predefined winning combinations associated with each of the rows include a pair, three of a kind and four of a kind, the card values of said pair, said three of a kind and said four of a kind having to correspond to the pre-assigned single unique playing card value for the row being paid.

5. The method of playing a poker style wagering game according to claim 2 wherein the predefined winning combinations associated with each of the columns include straights and royal flushes.

6. The method of playing a poker style wagering game according to claim 1 further including a step, between steps c) and d), of the player selecting which of the dealt cards to hold and which to discard, said discards being shuffled and re-dealt to fill unoccupied matrix spaces.

7. The method of playing a poker style wagering game according to claim 6 wherein the player may select, two or more times, which of the re-dealt cards to hold and which to discard, said discards being shuffled and re-dealt to fill unoccupied matrix spaces each time.

8. A method of playing a wagering card game including:

a. accepting a player wager;

b. providing a gaming table lay out having pre-defined locations to receive a matrix of playing cards defined by m rows, and n columns;

c. pre-assigning each of said m rows or n columns of the matrix with a single unique playing card value, wherein the card values are selected from the group consisting of Twos, Threes, Fours, Fives, Sixes, Sevens, Eights, Nines, Tens, Jacks, Queens, Kings and Aces;

d. dealing a plurality of playing cards to fill the m rows and n columns;

e. comparing the playing cards in each of the m rows, and the n columns, with predefined winning combinations, wherein a first set of pre-established winning combinations is based on poker hand ranks and a second set of pre-established winning combinations is based on matches between cards and the pre-assigned unique playing card rank; and f. paying said player according to a pre-established pay table.

9. The method of playing a wagering card game according to claim 8 wherein said matrix is a 5×4 matrix.

10. The method of playing a wagering card game according to claim 8 wherein the plurality of playing cards includes Tens, Jacks, Queens, Kings and Aces of each card suit, namely Spades, Clubs, Hearts and Diamonds from a standard 52 card deck.

11. The method of playing a wagering card game according to claim 8 wherein the predefined winning combinations associated with each of the rows include a pair, three of a kind and four of a kind, the card values of said pair, said three of a kind and said four of a kind having to correspond to the pre-assigned single unique playing card value for the row being paid.

12. The method of playing a wagering card game according to claim 9 wherein the predefined winning combinations associated with each of the columns include straights and royal flushes.

13. The method of playing a poker style game according to claim 8 further including a step, between steps d) and e), of the player selecting which of the dealt cards to hold and which to discard said discards being shuffled and re-dealt to fill unoccupied matrix spaces.

14. The method of playing a poker style wagering game according to claim 13 wherein the player may select, two or more times, which of the re-dealt cards to hold and which to discard, said discards being shuffled and re-dealt to fill unoccupied matrix spaces each time.

* * * * *